US009598196B2

(12) United States Patent
Choi

(10) Patent No.: US 9,598,196 B2
(45) Date of Patent: Mar. 21, 2017

(54) MANUAL WRAPPING APPARATUS

(71) Applicant: TAEGYEONG M&T CO., LTD., Gyeonggi-do (KR)

(72) Inventor: Dae-Kyung Choi, Gyeonggi-do (KR)

(73) Assignee: TAEGYEONG M&T CO., LTD., Gyeonggi-Do (KR)

( * ) Notice: Subject to any disclaimer, the term of this patent is extended or adjusted under 35 U.S.C. 154(b) by 146 days.

(21) Appl. No.: 14/406,801

(22) PCT Filed: Jun. 24, 2013

(86) PCT No.: PCT/KR2013/005519

§ 371 (c)(1),
(2) Date: Dec. 10, 2014

(87) PCT Pub. No.: WO2014/003375

PCT Pub. Date: Jan. 3, 2014

(65) Prior Publication Data

US 2015/0136895 A1 May 21, 2015

(30) Foreign Application Priority Data

Jun. 26, 2012 (KR) ..... 10-2012-0068604

(51) Int. Cl.
*B65B 67/08* (2006.01)

(52) U.S. Cl.
CPC ..... *B65B 67/085* (2013.01)

(58) Field of Classification Search
CPC ..... B65H 23/06; B65H 23/08; B65H 59/00; B65H 59/04; B65H 67/08; B65H 75/406;
(Continued)

(56) References Cited

U.S. PATENT DOCUMENTS 1,226,928 A * 5/1917 Updike ..... 225/44
1,364,259 A * 1/1921 Eaton ..... B65H 59/04 242/156

(Continued)

FOREIGN PATENT DOCUMENTS

KR 1020070016449 2/2007
KR 2020110009654 10/2011
WO WO0226564 4/2002

*Primary Examiner* — William A Rivera
(74) *Attorney, Agent, or Firm* — IPLA P.A.; James E. Bame

(57) ABSTRACT

A manual wrapping apparatus includes: a wrap roll having a wrap wound around the outer surface thereof; a support rod, one end of which is provided with a first gripping area for the operator and the other end of which is coupled to the wrap roll; and a rotating grip portion which is rotatably coupled on one side on the outer surface of the support rod in order to provide a second gripping area for the operator. According to the present invention: the operator does not have to bend his or her body during the wrapping operation but can carry out the operation while maintaining a standing position so that there is no burden on the body of the operator despite the wrapping operation being performed over a long period of time; sufficient tension is added to the wrap being wrapped around a target object by using an additional stopper member so that the target object can be firmly fixed; and consumption of wrapping is reduced by the amount of the added tension so that logistics costs can be reduced. In addition, the coupling depths of an upper support rod and a lower support rod are adjusted using a coupling depth control means to adjust the total length of the support rod so that even a wrapping target object positioned at a high place can be wrapped with ease.

2 Claims, 5 Drawing Sheets

(58) Field of Classification Search
CPC . B65H 2402/412; B65B 67/00; B65B 67/085; Y10T 156/18; Y10T 156/1788; Y10T 156/1795
See application file for complete search history.

(56) References Cited

U.S. PATENT DOCUMENTS

| | | | | |
|---|---|---|---|---|
| 4,484,717 | A | 11/1984 | Goldstein | |
| 4,817,762 | A * | 4/1989 | Powell | B65B 67/085 188/67 |
| 5,749,539 | A * | 5/1998 | Ratzel | B31D 5/0047 242/588.2 |
| 5,779,179 | A * | 7/1998 | Zentmyer | B65B 67/085 242/423.2 |
| 7,401,449 | B2 * | 7/2008 | Watson | B65B 67/085 242/423 |
| 7,543,426 | B1 * | 6/2009 | Phero | B65B 67/085 156/574 |
| 2007/0151208 | A1 * | 7/2007 | Huang | B65B 67/085 53/390 |
| 2008/0072543 | A1 * | 3/2008 | Watson | B65B 67/085 53/441 |

* cited by examiner

MANUAL WRAPPING APPARATUS

BACKGROUND

The present invention relates to a manual wrapping apparatus, and more particularly, to a manual wrapping apparatus to capable of firmly wrapping packs and packing boxes stacked in multiple layers on a pallet.

Among the products manufactured generally in a production line product, the product manufactured in pack units and the product packed in a box are shipped in a state that a plurality of packs is stacked in multiple layers on a pallet and the boxes is stacked in multiple layers respectively.

At this time, in order to prevent the packs stacked in multiple layers and the contents contained in the packing box from being damaged owing to the impact generated during the loading and the transport of the vehicle, the outsides thereof are covered with the wrap.

Conventionally, the operation of wrapping the outside of the packs stacked in multiple layers on the pallet and the boxes stacked in multiple layers is manually conducted by the operator. Thus, in a state that the operator holds the end portion of a branch pipe of the wrap roll having a wound wrap with both hands, a proper tension is added to the wound wrap of the wrap roll, so that the wrapping operation is performed by means of the gripping power using both hands of the operator.

However, in the course of wrapping the packs stacked in multiple layers on the pallet and the boxes stacked in multiple layers from the upper end portion and to the lower end portion thereof or from the lower end portion and to the upper end portion thereof by means of the operator, since the operator have to bend and stretch his or her body repeatedly, there is a burden on the body of the operator over a long period of time. Also, since the operator holds the branch pipe of the wrap roll having the wound wrap with his hands so as to wrap it, there is a risk of injury in that it gets a cut on his hand or is worn out. In order to solve this problem, where it puts on wear gloves, since it does not generated a proper slip between the branch pipe of the wrap roll and the gloves, the glove is dragged therein according to the rotation of the branch pipe of the wrap roll. Accordingly, there is a problem in that it cannot perform the wrapping operation properly.

Thus, recently, a wrapping machine 200 including the wrap roll 300 having the wrap 320 wound in multiple layers on the branch pipe 310 and a circular rod 400 attached and detached to the wrap roll 300 has been proposed.

The wrapping machine 200 includes a seating portion 430 rotatably inserted into the inserting hole 330 of the branch pipe 310 of the wrap roll 300, a gripping portion 500 for grapping it by means of the operator, and a separation prevention prominence 410 and pushing prevention prominence 420 for preventing the separation and pushing of the wrap roll 300 formed at the front and rear ends of the seating portion 430, so that the wrap roll 300 is mounted on the seating portion 430 of the wrapping machine 200 by means of the operator and then, the wrapping operation is performed while holding the a gripping portion 500, thereby preventing the injury of the operator generated from the wrapping operation.

However, in the course of the wrapping operation, since there still remains the repetitive operation of bending and stretching the body of the operator, it can put stress on the body of the operator during the lengthy wrapping operation. Also, since it does not exist the separate fixing means for fixing the rotating wrap roll 300 mounted in the seating portion 430, it cannot add the sufficient tension thereto.

Accordingly, there is a problem in that the plurality of packs and the boxes stacked in multiple layers on the pallet are wrapped loosely.

SUMMARY OF THE INVENTION

Accordingly, the present invention has been made to solve the above-mentioned problems occurring in the prior art, and a object of the present invention is to provide a manual wrapping apparatus in that the operator does not have to bend his or her body during the wrapping operation but can carry out the operation while maintaining a standing position and a sufficient tension is added to the wrap being wrapped around a target object by using an additional stopper member.

Another object of the present invention is to provide a manual wrapping apparatus capable of selectively adjusting the length of the support rod.

In order to accomplish this object, there is provided a manual wrapping apparatus including: a wrap roll having a wrap wound around an outer surface thereof; a support rod having one end portion for providing a first gripping area for an operator thereon and the other end portion coupled to the wrap roll; and a rotating grip portion rotatably coupled on one side of an outer surface of the support rod and having a second gripping area for the operator thereon.

Preferably, the support rod is passed through the wrap roll and a fixing member for fixing both ends of the wrap roll to the support rod is formed thereon.

Preferably, the fixing member includes a first supporting member for supporting one end portion of the wrap roll and coupled to one side of an outer surface of the support rod corresponding to one end of the wrap roll, a second supporting member for supporting the other end portion of the wrap roll and coupled to one side of the outer surface of the support rod corresponding to the other end of the wrap roll, and a separation preventing member for preventing the separation of the second supporting member and coupled to the other end portion of the support rod.

Preferably, the rotating grip portion includes: a rotating member rotatably coupled to the support rod; a pair of support pieces located on both ends of the rotating member respectively and fixed and coupled to the support rod so as to support the rotating member thereon; and bearing members interposed between the pair of support pieces and the rotating member.

Preferably, the support rod includes: an upper support rod having one side of an outer surface rotatably coupled to the rotating grip portion and one end portion for providing the first gripping area for the operator; a lower support rod having one end portion coupled to the wrap roll and the other end portion slidably coupled to the upper support rod; and a coupling depth adjusting means for adjusting a coupling depth of the upper support rod and the lower support rod.

According to one aspect of the present invention, there are effects in that the operator does not have to bend his or her body during the wrapping operation but can carry out the operation while maintaining a standing position so that there is no burden on the body of the operator despite the wrapping operation being performed over a long period of time and the sufficient tension is added to the wrap being wrapped around a target object by using an additional stopper member so that the target object can be firmly fixed and consumption of wrapping is reduced by the amount of the added tension so that logistics costs can be reduced.

In addition, the coupling depths of an upper support rod and a lower support rod are adjusted using a coupling depth control means to adjust the total length of the support rod so that even a wrapping target object positioned at a high place can be wrapped with ease.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE INVENTION

Hereinafter, an exemplary embodiment of the present invention will be described in detail with reference to the accompanying drawings. The known functions and configurations will be omitted for the description that may unnecessarily obscure the gist of the invention in detail.

Figure 1:
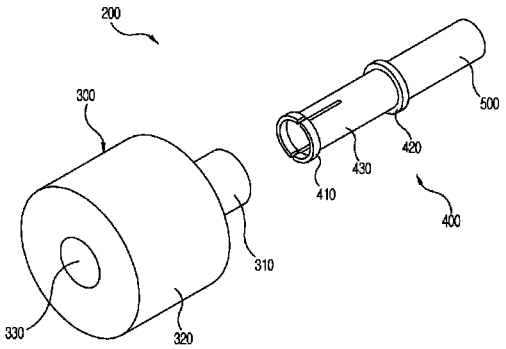
FIG. 1 is an entire perspective view of a conventional manual wrapping apparatus.
Figure 2:
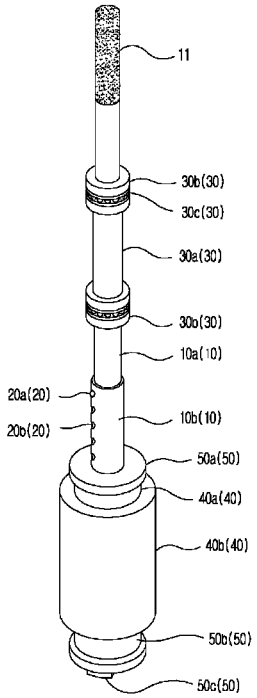
FIG. 2 is an entire perspective view of a manual wrapping apparatus according to the present invention.
Figure 3:
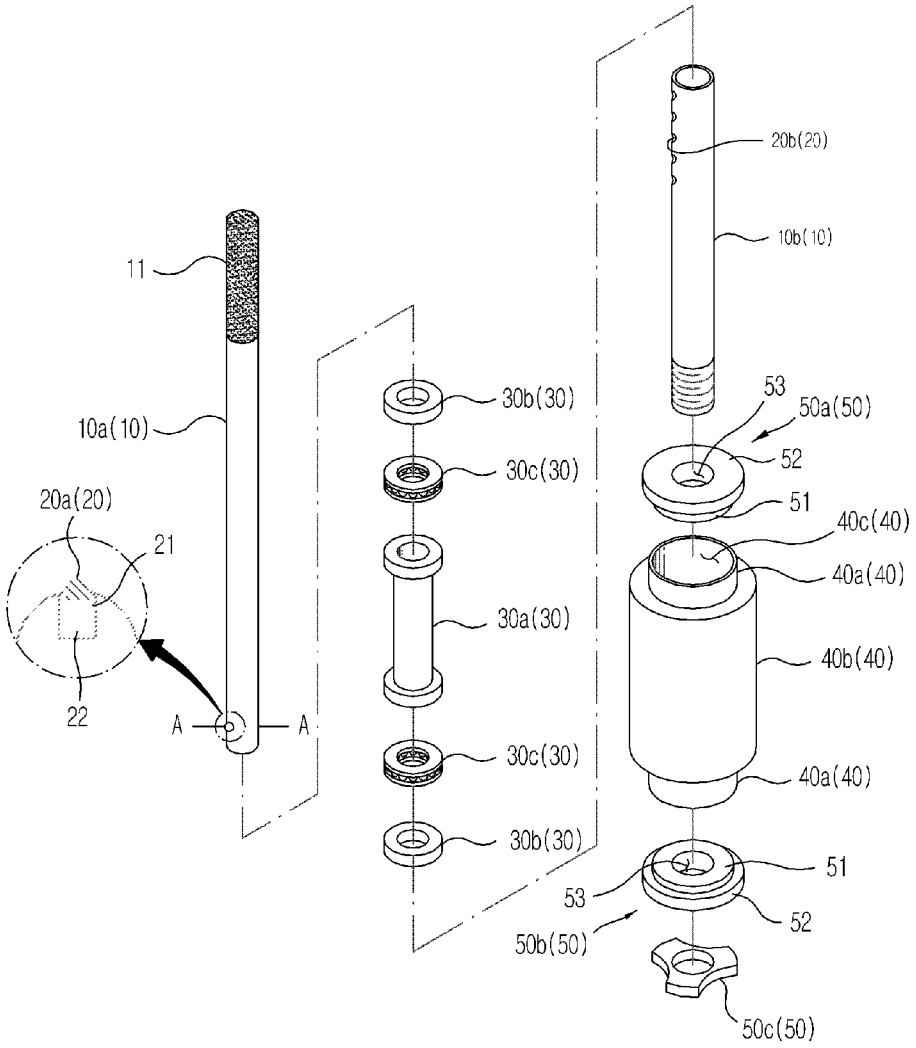
FIG. 3 is an exploded perspective view of a manual wrapping apparatus according to the present invention.
Figure 4:
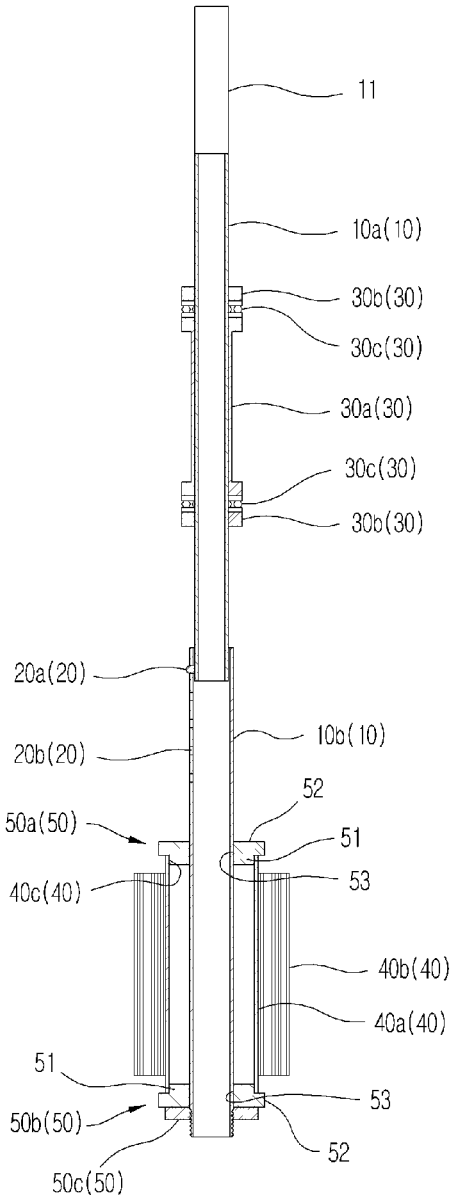
FIG. 4 is a cross-sectional view of a manual wrapping apparatus according to the present invention.

FIG. 2 is an entire perspective view of a manual wrapping apparatus according to the present invention, FIG. 3 is an exploded perspective view of a manual wrapping apparatus according to the present invention, and FIG. 4 is a cross-sectional view of a manual wrapping apparatus according to the present invention.

Referring to FIG. 2 through FIG. 4, the manual wrapping apparatus according to the present invention includes a wrap roll 40 having a wrap wound around an outer surface thereof, a support rod 10 coupled to the wrap roll 40, and a rotating grip portion 30 rotatably coupled on one side on an outer surface of the support rod 10.

The wrap roll 40 having a pipe structure made of a thick paper includes a branch pipe 40*a* and the wrap 40*b* wound around the outer surface of the branch pipe 40*a* in several layers. Also, an inserting hole 40*c*, which is formed at the branch pipe 40*a*, serves to provide a space for coupling with an external device.

The support rod 10 of a hollow type can be integrally formed as a circular rod shape. However, in this embodiment, it will be explained as a two-stage structure including an upper support rod 10*a*, a lower support rod 10*b*, and a coupling depth adjusting means 20.

The upper support rod 10*a* includes a fixing grip portion 11 for providing a first gripping area for the operator on one end portion thereof and a latching protrusion 20*a* formed on an outer surface of the other end portion thereof.

Here, as shown in the enlarged view of enlarging the sectional view of the A-A portion of FIG. 3, a groove 21 is formed at the inner portion of one side of the upper support rod 10*a* and the latching protrusion 20*a* is latched and coupled to the inside of the upper support rod 10*a* through the groove 21. Also, since an elastic member 22 is interposed between the groove 21 and the latching protrusion 20*a*, the latching protrusion 20*a* is normally exposed to the outer surface of the upper support rod 10*a*. However, by the press operation of the operator, the latching protrusion 20*a* can be moved to the groove 21, which is formed at the inside of the upper support rod 10*a*.

The lower support rod 10*b* includes one end portion penetrated through and coupled to the inserting hole 40*c*, which is formed the branch pipe 40*a* of the wrap roll 40 and the other end portion having larger diameter than the upper support rod 10*a* so as to slidably couple the upper support rod 10*a* to the inner surface of the lower support rod 10*b*.

Also, a female thread is formed at one end portion of the lower support rod 10*b*, which is coupled to the wrap roll 40.

Moreover, a plurality of latching grooves 20*b* is formed at one side of the outer surface of the other end portion of the lower support rod 10*b*, which is slidably coupled to the upper support rod 10*a*, and is coupled and corresponded to the latching protrusion 20*a*, which is longitudinally formed on the upper support rod 10*a*.

As described above, when the upper support rod 10*a* is coupled to the inner circumferential surface of the lower support rod 10*b* by means of the coupling depth adjusting means 20 including the latching protrusion 20*a* formed on the upper support rod 10*a* and the latching grooves 20*b* formed at the lower support rod 10*b*, the latching protrusion 20*a*, which is formed on the upper support rod 10*a* is latched to the latching grooves 20*b*, which is formed at the lower support rod 10*b*, to be rigidly fixed.

Then, the operator pushes the latching protrusion 20*a* formed on the upper support rod 10*a* and selects any one of the plurality of the latching grooves 20*b* formed at the lower support rod 10*b* to be coupled, so that it adjust the entire length of the support rod 10 including the upper support rod 10*a* and the lower support rod 10*b*, thereby easily wrapping the wrapping object located in a high place.

Although the two-stage structure of the support rod 10 was explained in the embodiments of the present invention above, it may be formed in two or more stages as well.

Also, the manual wrapping apparatus further include a fixing member 50 for fixing and supporting both ends of the wrap roll 40, that one end portion of the lower support rod 10*b* is passed through and coupled to, and preventing the wrap roll 40 from being separated from the outside of the lower support rod 10*b*.

Here, the fixing member 50 includes a first supporting member 50*a* for supporting the inner end of the wrap roll 40 and coupled to one side of the outer surface of the lower support rod 10*b* corresponding to one end of the wrap roll 40 and located at the inner end of the wrap roll 40, that the lower support rod 10*b* is passed through and coupled to, a second supporting member 50*b* for supporting the outer end of the wrap roll 40 and coupled to one side of the outer surface of the lower support rod 10*b* corresponding to the other end of the wrap roll 40 and located at the outer end of the wrap roll 40, that the lower support rod 10*b* is passed through and coupled to, and a separation preventing member 50*c* coupled to the outside of the second supporting member 50*b*.

The lower support rod 10*b* is passed through a through hole 53, which is formed at a middle portion of the first supporting member 50*a*, to be coupled. Also, the first supporting member 50*a* is fixed and coupled to one side of the lower support rod 10*b* located at the inner end of the wrap roll 40.

Also, the first supporting member 50*a* is coupled to the inserting hole 40*c*, which is formed at the branch pipe 40*a* of the wrap roll 40. The first supporting member 50*a* includes an inserting portion 51 for fixing the wrap roll 40 and a supporting portion 52 formed larger than the diameter of the branch pipe 40*a* of the wrap roll 40 and supporting the wrap roll 40 and preventing the separation thereof.

The shape of the second supporting member 50*b* is the same as that of the first supporting member 50*a* and is coupled to one side of the lower support rod 10*b* located at the outer end of the wrap roll 40.

The separation preventing member 50*c* includes a male thread, which is coupled to the female thread formed at one end portion of the lower support rod 10*b*, formed at the inner circumferential surface thereof, which is coupled to the lower support rod 10*b*, so that it is screw-coupled to the lower support rod 10*b*, thereby preventing the second supporting member 50*b* from being separated from the outside of the lower support rod 10*b*. Simultaneously, the separation preventing member 50*c* allows the second supporting member 50*b* to be pressurized toward the inside thereof, so that it serves to rigidly fix both ends of the wrap roll 40 together with the first supporting member 50*a* fixed and coupled to the inside of the lower support rod 10*b*.

In this embodiment, the separation preventing member 50*c* is separately formed at the second supporting member 50*b*. However, the present invention is not limited thereto. The separation preventing member 50*c* can be integrally formed at the second supporting member 50*b*.

The rotating grip portion 30 includes a rotating member 30*a*, a pair of support pieces 30*b* fixed and coupled to one side of the upper support rod 10*a*, on which both ends of the rotating member 30*a* is located respectively and supporting the rotating member 30*a*, and bearing members 30*c* interposed between the pair of support pieces 30*b* and the rotating member 30*a*.

The rotating member 30*a* is formed as a cylindrical pipe and includes a circular rim extended outwardly and formed at both ends thereof. Also, the rotating member 30*a* is rotatably coupled between the latching protrusion 20*a*, which is formed at the upper support rod 10*a*, and the fixing grip portion 11, thereby providing a second gripping area for the operator.

The support piece 30*b* is in the form of a disc shape having a diameter equal to the both ends of the rotating member 30*a*. The pair of support pieces 30*b* are fixed and coupled to one side of the upper support rod 10*a*, on which both ends of the rotating member 30 is located, respectively, so that it serves to support the rotating member 30*a* and prevent the rotating member 30*a* from being separated from the outside of the upper support rod 10*a*.

The bearing members 30*c* are interposed between the pair of support pieces 30*b* and the rotating member 30*a*, so that it serves to allow the rotating member 30*a* to be smoothly rotated.

Figure 5:
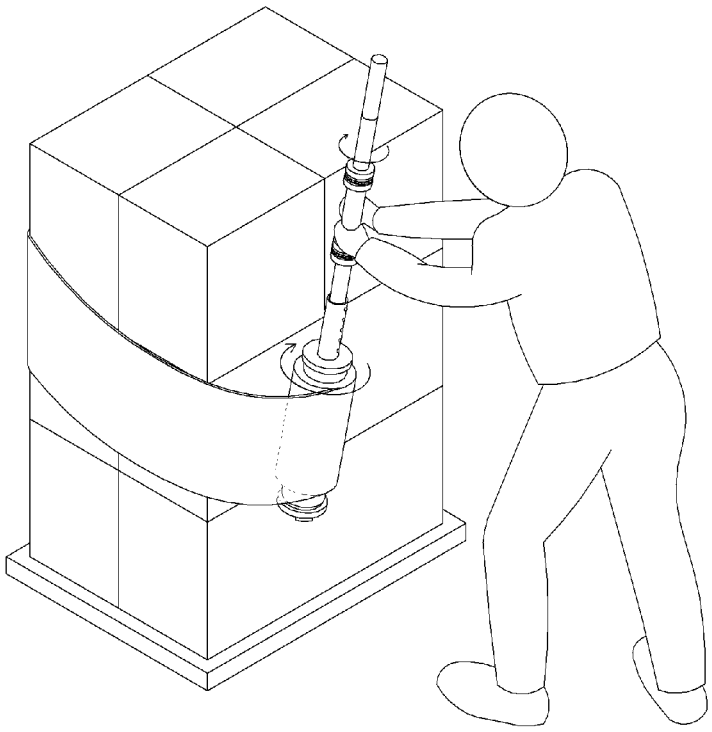
FIG. 5 is a schematic diagram illustrating an operation of winding a wrapping object by using a manual wrapping apparatus according to the present invention.
Figure 6:
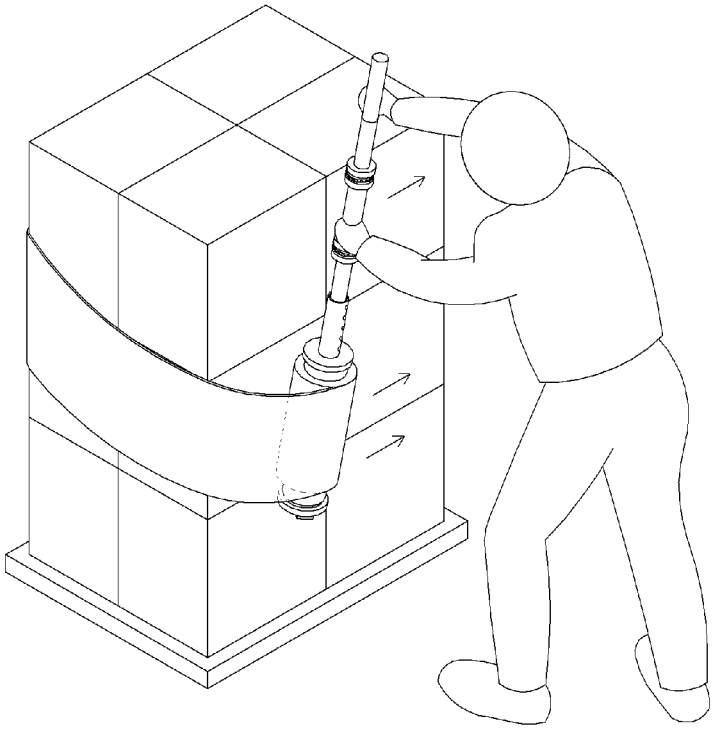
FIG. 6 is a schematic diagram illustrating an operation of applying a tension to a wrap for winding a wrapping object by using a manual wrapping apparatus according to the present invention.
Figure 7:
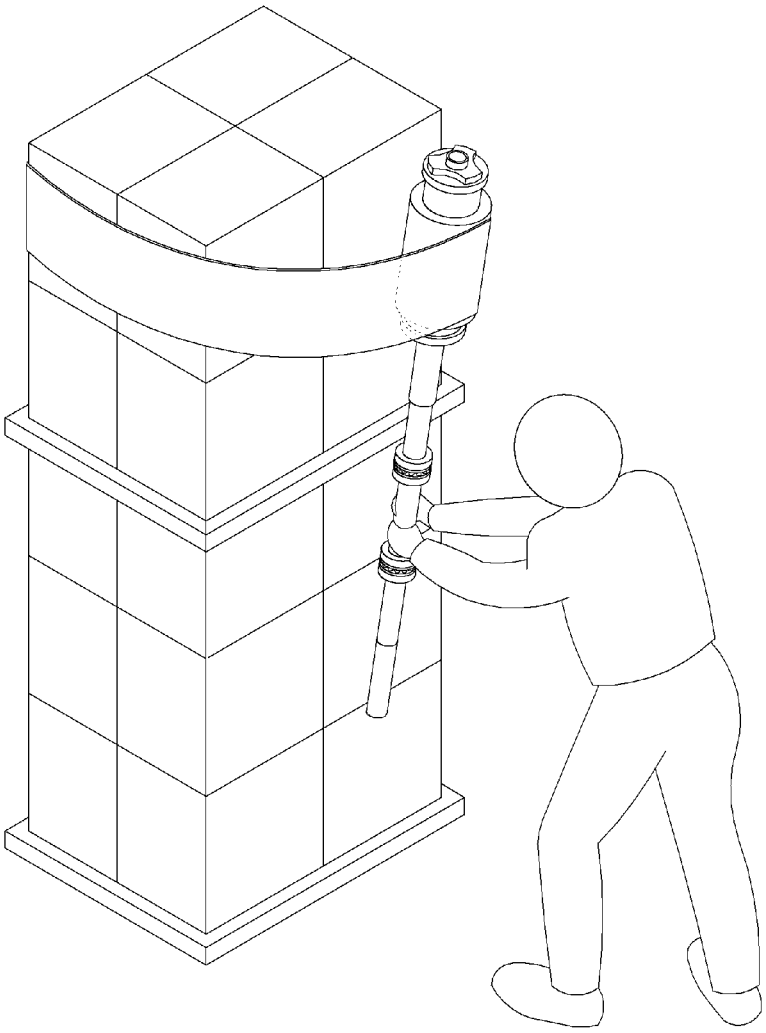
FIG. 7 is a schematic diagram illustrating an operation of winding a wrapping object located in a high position by using a manual wrapping apparatus according to the present invention.

FIG. 5 is a schematic diagram illustrating an operation of winding a wrapping object by using a manual wrapping apparatus according to the present invention, FIG. 6 is a schematic diagram illustrating an operation of applying a tension to a wrap for winding a wrapping object by using a manual wrapping apparatus according to the present invention, and FIG. 7 is a schematic diagram illustrating an operation of winding a wrapping object located in a high position by using a manual wrapping apparatus according to the present invention.

Hereinafter, the manual wrapping apparatus according to the present invention will be described with reference to FIG. 5 and FIG. 6.

As shown, in a state that the end of the wound wrap of the wrap roll is attached to one side of the wrapping object, which is loaded on the pellet and the operator holds only the rotating grip portion with both hands, if it is moved in the wrapping direction of the wrapping object, the upper support rod, which is coupled to the rotating grip portion, is rotated and then, the lower support rod, which is coupled to the upper support rod, and the wrap roll, which is coupled to the lower support rod, are rotated, so that the wrapping object is wrapped while the wound wrap of the wrap roll is loosen.

Also, in order to tightly wrap the wrapping object, it is necessary to apply a sufficient tension to the wrap for wrapping the wrapping object. Where it applies the tension to the wrapping object, if the operator holds the fixing grip portion with one hand, the rotation of the upper support rod is suppressed. Thus, the rotation of the lower support rod coupled to and rotated together with the upper support rod and the wrap roll coupled to the lower support rod is suppressed.

At this time, in a state that the operator holds the rotating grip portion and the fixing grip portion with both hands in the wrapping direction of the wrapping object, if a force is applied thereto, the tension can be applied to the wrap, the wrapping object can be wrapped tightly. Also, since the consumption of the wrap wound on the wrapping object is reduced according to the adding of the tension, the distribution cost can be reduced.

Referring to FIG. 7, where the pellets having the wrapping object are stacked in multiple stages and the object to be wrapped is located in a high position, the whole length of the support rod is adjusted in lengths capable of wrapping the corresponding wrapping object by using the coupling depth adjusting means, which is formed at the upper support rod and the lower support rod of the manual wrapping apparatus according to the present invention. Then, the manual wrapping apparatus is upside down and the end of the wrap is attached to one side of the lower end of the wrapping object. Continuously, in a state that the operator holds only the rotating grip portion with both hands, if it is moved in the wrapping direction of the wrapping object, the upper support rod, which is coupled to the rotating grip portion, is rotated and then, the lower support rod, which is coupled to the upper support rod, and the wrap roll, which is coupled to the lower support rod, are rotated, so that the wrapping object is wrapped while the wound wrap of the wrap roll is loosen.

Similarly, where it applies the tension to the wrapping object, in a state that the operator holds the fixing grip portion with one hand, if the force is applied in the wrapping direction of the wrapping object, the rotation of the support rod and the rotation of the wrap roll rotated together with the support rod are suppressed.

Although a preferred embodiment of the present invention has been described for illustrative purposes, those skilled in the art will appreciate that various modifications, additions and substitutions are possible, without departing from the scope and spirit of the present invention as disclosed in the accompanying claims.

The invention relates to a manual wrapping apparatus in that the operator can carry out the wrapping operation while maintaining the operator standing position and easily wrap the wrapping object located even in a high position and can be usefully used in the industrial fields such as distribution centers and others, in that the articles are wrapped by using the wrap.

The invention claimed is:

1. A manual wrapping apparatus comprising:

a wrap roll having a wrap wound around an outer surface thereof;

a support rod having one end portion for providing a first gripping area for an operator thereon and the other end portion coupled to the wrap roll;

a rotating grip portion rotatably coupled on one side of an outer surface of the support rod, and comprising a rotating member, a pair of support pieces located on both ends of the rotating member respectively and fixed and coupled to the support rod so as to support the rotating member thereon, and bearing members interposed between the pair of support pieces and the rotating member; and a fixing member for fixing both ends of the wrap roll to the support rod, wherein the support rod is passed through the wrap roll and the fixing member comprises a first supporting member for supporting one end portion of the wrap roll and coupled to one side of an outer surface of the support rod corresponding to one end of the wrap roll, a second supporting member for supporting the other end portion of the wrap roll and coupled to one side of the outer surface of the support rod corresponding to the other end of the wrap roll, and a separation preventing member for preventing the separation of the second supporting member integrally or separately formed on the second supporting member and coupled to the other end portion of the support rod.

2. A manual wrapping apparatus as claimed in claim 1, wherein the support rod comprises:

an upper support rod having one side of an outer surface rotatably coupled to the rotating grip portion and one end portion for providing the first gripping area for the operator;

a lower support rod having one end portion coupled to the wrap roll and the other end portion slidably coupled to the upper support rod; and a coupling depth adjusting means for adjusting a coupling depth of the upper support rod and the lower support rod.

* * * * *